US005900584A

United States Patent [19]

Cady et al.

[11] Patent Number: 5,900,584

[45] Date of Patent: May 4, 1999

[54] ENLARGED WALL SWITCH PLATE

[76] Inventors: James L. Cady, Rt. 1, Box 126C, Santa Fe, N.M. 87501; Philip O. Brady, 3809 20th St. #208, San Francisco, Calif. 94114

[21] Appl. No.: 08/853,611

[22] Filed: May 6, 1997

[51] Int. Cl.[6] ..... H01H 3/02

[52] U.S. Cl. ..... 174/66; 200/332; 220/241

[58] Field of Search ..... 174/66, 67; 220/241, 220/242; 200/332, 332.1, 339

[56] References Cited

U.S. PATENT DOCUMENTS

| | | | |
|---|---|---|---|
| 1,660,346 | 2/1928 | Neal | 220/3.8 |
| 1,705,014 | 3/1929 | Hubbell | 174/58 |
| 2,043,865 | 6/1936 | Place | 174/66 |
| 2,740,873 | 4/1956 | Cronk | 200/295 |
| 3,011,008 | 11/1961 | Slater | 174/66 |
| 3,121,778 | 2/1964 | Sander et al. | 200/331 |
| 3,188,438 | 6/1965 | Lovasco | 174/66 |
| 3,197,549 | 7/1965 | Good | 174/66 |
| 3,518,356 | 6/1970 | Friedman | 174/66 |
| 3,619,477 | 11/1971 | Rasmussen | 174/56 |
| 3,953,933 | 5/1976 | Goldstein | 40/642.02 |
| 4,230,917 | 10/1980 | Osika | 200/339 |
| 4,234,774 | 11/1980 | Paparella | 200/330 |
| 4,534,486 | 8/1985 | Eidson | 220/241 |
| 4,731,511 | 3/1988 | Steinhilber et al. | 200/330 |
| 4,835,343 | 5/1989 | Graef | 174/66 |
| 4,972,045 | 11/1990 | Primeau | 174/66 |
| 5,180,886 | 1/1993 | Dierenbach et al. | 174/66 |
| 5,189,259 | 2/1993 | Carson | 174/66 |
| 5,213,204 | 5/1993 | Sommer | 200/303 |
| 5,577,602 | 11/1996 | Conner et al. | 174/66 |
| 5,675,125 | 10/1997 | Hollinger | 174/66 |

FOREIGN PATENT DOCUMENTS

| | | |
|---|---|---|
| 822183 | 10/1959 | United Kingdom . |
| 1588134 | 4/1981 | United Kingdom . |
| 88/09074 | 11/1988 | WIPO . |

*Primary Examiner*—Nestor Ramirez
*Assistant Examiner*—Joseph Waks

[57] ABSTRACT

An enlarged cover plate assembly is used with a conventional electrical wall switch having a rotatable rocker arm within a mounting bracket with threaded mounting holes with a spacing for conventional cover plates. An enlarged cover plate has an area substantially greater than the area of the wall switch and has a front surface forming a decorative surface and a back surface facing the wall switch. The cover plate further defines an aperture connecting the front and back surfaces and having a length less than the distance between the mounting holes. The enlarged cover plate is attached to the switch mounting bracket. Two flanges extend between the back surface of the enlarged cover plate and the wall switch and are oriented so that the rocker arm moves parallel with the flanges. A rocker arm extension toggle has a first actuating portion that is accessible from the front surface of the enlarged cover plate and a second engaging portion that has a cavity therein for loosely engaging the wall switch rocker arm so that the toggle moves through a greater angle than the switch rocker arm as the toggle rotates to actuate the switch rocker arm. The toggle engages the flanges to define rotation of the toggle within the enlarged plate and within the length of the aperture.

16 Claims, 5 Drawing Sheets

ENLARGED WALL SWITCH PLATE

BACKGROUND OF THE INVENTION

This invention relates to light switch cover plates, and, more particularly, to decorative light switch cover plates.

Wall switches are conventionally mounted in outlet boxes that are recessed in an opening in a wall. The opening is covered by a switch plate that defines an aperture for access to a switch rocker arm that acts to connect and disconnect an electrical circuit. The switch plate is attached to the portion of the switch in the outlet box by two screws that pass through two openings in the switch plate to threadedly mount to a mounting plate through which the actuating member passes. The distance between the threaded holes in the mounting plate is standardized at 2½ inches.

Normal switch plates are sized to just cover the outlet boxes, e.g., 4½ inches long by 2¾ inches wide, and cover a relatively small area. Also, conventional toggles for actuating the switch are relatively small and can be difficult to operate, particularly for persons with some disabilities or in a dark or dimly lit room. Larger switch plates have been provided in order to prevent soiling of the wall area around the wall switch, to provide a switch that is more readily located in a dimly lit room, and to provide a relatively broad surface that is suitable for decorating. But such devices have used conventional toggles.

One example of such a large switch plate is shown in U.S. Pat. No. 4,234,774, issued Nov. 18, 1980, to Paparella. As described therein, an adapter plate is mounted to a conventional switch box and provides threaded wall plate mounting holes that are spaced apart further than conventional mounting holes to provide for sliding movement of a plate that supports a rotatable extension for the wall switch rocker arm. The additional space is required to accommodate the throw length of an extension to the rocker arm of the switch box.

Other styles for altering a conventional switch toggle are shown in U.S. Pat. Nos. 4,753,511 and 3,121,778. The '511 patent shows a slider cap that interacts with the toggle to replace the arcuate toggle motion with a linear cap motion. The '778 patent shows an extension handle rotateably mounted on a yoke that is wedged onto the switch toggle. The yoke includes a flange to hold the yoke on a switch cover plate, which further defines an arced portion to accommodate the throw of the yoke on the toggle.

Accordingly, it is an object of the present invention to provide an enlarged switch plate for use with conventional wall switches that attaches directly or indirectly to the wall switch mounting.

One other object of the present invention is to provide an enlarged toggle switch for easy manipulation by persons with disabilities.

It is another object of the present invention to provide a rotatable extension for the wall switch rocker arm that has a throw length compatible with the spacing between conventional mounting holes in a wall switch.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise an enlarged cover plate assembly for use with a conventional electrical wall switch having a rotatable rocker arm within a mounting bracket with threaded mounting holes with a spacing for conventional cover plates. An enlarged cover plate has an area substantially greater than the area of the wall switch and has a front surface forming a decorative surface and a back surface facing the wall switch. The cover plate further defines an aperture connecting the front and back surfaces and having a length less than the distance between the mounting holes. The enlarged cover plate is attached to the switch mounting bracket. Two flanges extend between the back surface of the enlarged cover plate and the wall switch and are oriented so that the rocker arm moves parallel with the flanges. A rocker arm extension toggle has a first actuating portion that is accessible from the front surface of the enlarged cover plate and a second engaging portion that has a cavity therein for loosely engaging the wall switch rocker arm so that the toggle moves through a greater angle than the switch rocker arm as the toggle rotates to actuate the switch rocker arm. The toggle engages the flanges to define rotation of the toggle within the enlarged plate and within the length of the aperture.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE INVENTION

Figure 1:
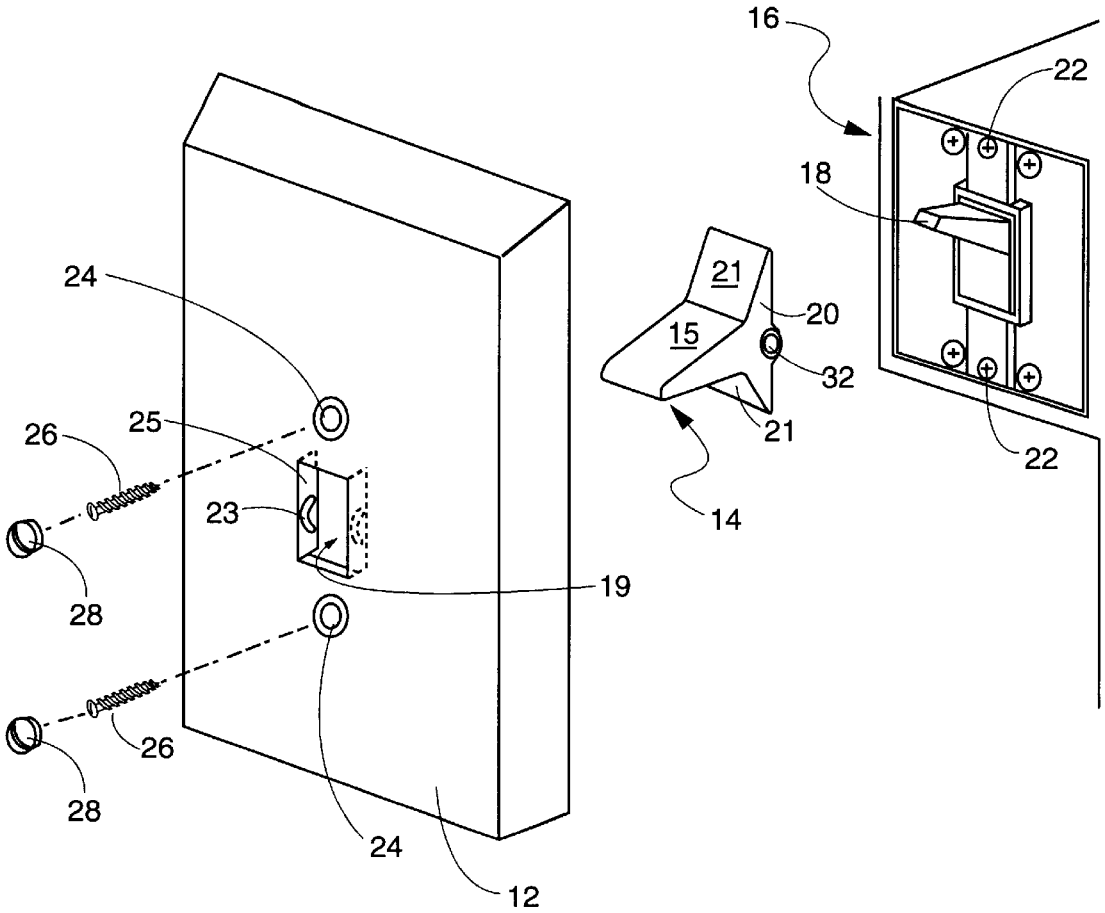
FIG. 1 is an exploded isometric view of an enlarged cover plate assembly according to the present invention.

FIG. 1 is an exploded isometric representation of an enlarged cover plate assembly according to one embodiment of the present invention. Enlarged cover plate 12 and rocker arm toggle extension 14 are configured to mount onto switch box 16. In one embodiment, conventional threaded attachment holes 22 provide for attaching cover plate 12 directly to switch box 16. Rocker arm toggle extension 14 engages switch box rocker arm 18 through aperture 19. As discussed below, rocker arm limit surfaces 21 enable movement of actuator portion 15 of rocker arm extension 14 to fully rotate rocker arm 18 within a throw distance defined by aperture 19, which is between attachment holes 24 that are spaced apart a distance that is the same as the distance between threaded attachment holes 22. Thus, enlarged cover plate 12 may be attached directly to switch box 16 without the need for any adapters or other complex attachment mechanism.

Figure 2:
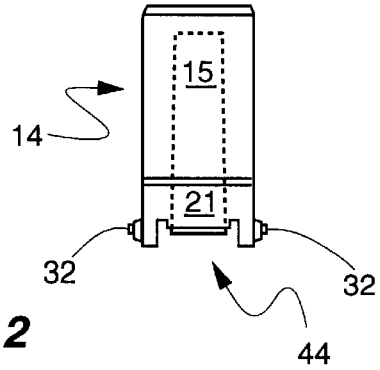
FIG. 2 is a top view of one embodiment of a rocker arm toggle extension according to the present invention.

Rocker arm extension 14 is depicted in top view in FIG. 2. Actuator portion 15 provides angled contact surface 21, similar to conventional rocker arm contact surfaces, to provide a more pleasing contact angle as rocker arm extension 14 rotates while actuating switch rocker arm 18 (FIG. 1). Rocker arm extension 14 further defines rocker arm cavity 44, which is sized to loosely accept a conventional rocker arm 18. In a preferred embodiment, the walls of cavity 44 are inwardly angled at 20 in the view shown and at 80 in a side view. Toggle 14 further includes an engagement contour 32 for maintaining arcuate rotation, as discussed below. Rocker limit surfaces 21 are provided on engaging member 20 so that rocker arm extension 14 can rotate within aperture 19 (FIG. 1) as movement of actuator portion 15 actuates rocker arm 18.

It will be appreciated that the loose fit of rocker arm 18 within cavity 44 enables toggle 14 to move through an angle greater than rocker arm 18 as toggle 14 rotates to actuate switch 16. The arcuate movement of toggle 14 enables the length of aperture 19 (FIG. 1) to be contained within the spacing of attachment holes 24 so that cover plate 12 can be attached directly to switch box 16. In one embodiment, a relatively simple enlarged cover plate assembly is obtained without the need for attachment adapters to match the attachment holes in the cover plate with the threaded attachment holed in a conventional switch plate.

Referring again to FIG. 1, in a preferred embodiment, toggle 14 loosely engages rocker arm 18. Switch plate 12 includes two flange plates 25 that depend from the back surface of switch plate 12 toward switch 16. Flange plates 25 are oriented in a plane parallel to movement of rocker arm 18 and bracket rocker arm 18. In one embodiment, flange plates 25 define arcuate grooves 23 and contour 32 on toggle 14 is a raised nub that may be, e.g., an elongated cylinder or a hemispher, that engage grooves 23 so that movement of toggle 14 is limited to a defined radius of rotation. As depicted below, the location of arcuate grooves 23 and contour 32 may be reversed. Enlarged cover plate 12 may be attached to switch box 16 with attachment screws 26 that threadingly engage threaded attachment holes 22 in an attachment plate for switch box 16. Screws 26 extend through holes 24 in cover plate 12, which may be counter sunk to accept decorative screw covers 28.

Figure 3A:
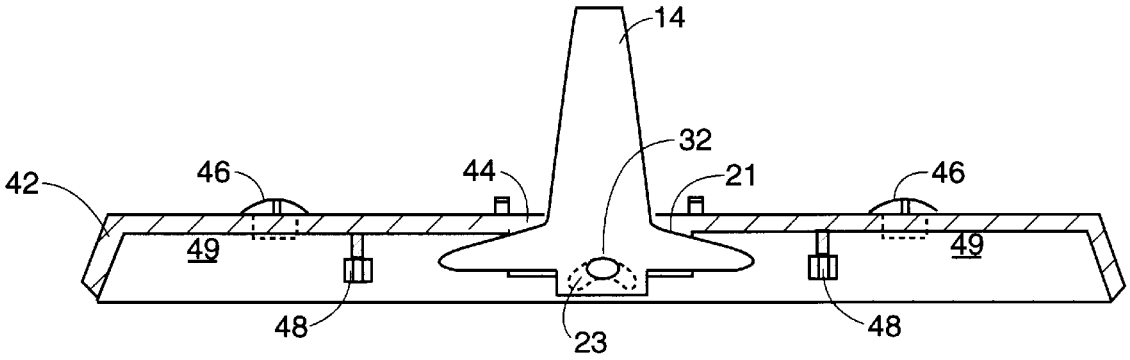
FIGS. 3A and 3B are a cross-sectional view of a cover plate shown in FIG. 1 and a wall mounting plate.
Figure 3B:
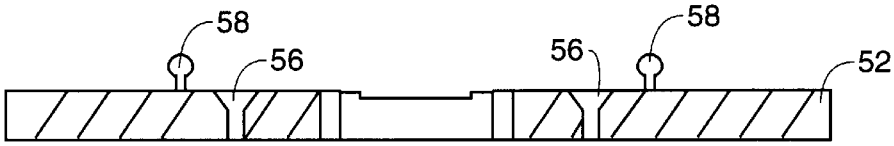

An alternate embodiment of an enlarged cover plate assembly is shown in cross-section in FIGS. 3A and 3B, where a wall plate 52 attaches to switch 16 (FIG. 1) and a cover plate 42 removably attaches to wall plate 52, preferably with a snap-on and off action. Cover plate 42 includes flanges 44 that extend toward wall plate 52 for engaging toggle 14. Arcuate grooves 23 may be defined in flanges 44 or in toggle 14 and mating nubs 32 may likewise be defined in flanges 44 or toggle 14. In a preferred embodiment, structural flanges 49 are provided to add rigidity to cover plate 42. In addition, edge portions of cover plate 42 are upwardly beveled so that a finger can readily engage the edge for removing the cover plate from the wall plate with any need for external appliances. As discussed below, a first engaging member 48 of a snap-together engaging system is provided on cover plate 42. As discussed herein, the engaging system includes a female cylinder with an internal spherical socket for first engaging member 48 and a male ball-shaped member for a second engaging member, discussed below. But it will be understood that any suitable snap-together configuration may be used to accomplish the purposes of the present invention. If desired for cosmetic or decorative purposes, false screw covers 46 may be fixed to a top surface of cover plate 42.

Wall plate 52 defines aperture 54 for accommodating rocker arm extension 18 (FIG. 1). Mounting holes 56 provide for attaching wall plate 52 to switch mounting holes 22 for switch 16 (FIG. 1). In an exemplary embodiment, wall plate 52 includes second engaging members 58 that engage first engaging members 48 in base plate 42 so that wall plate 52 may be readily attached and removed from base plate 42. As shown in the figures, first engaging member 48 is a cylindrical socket and second engaging member 58 is a ball-shaped extension to form a ball-and-socket connection so the parts may be simply press fit together.

Figure 4:
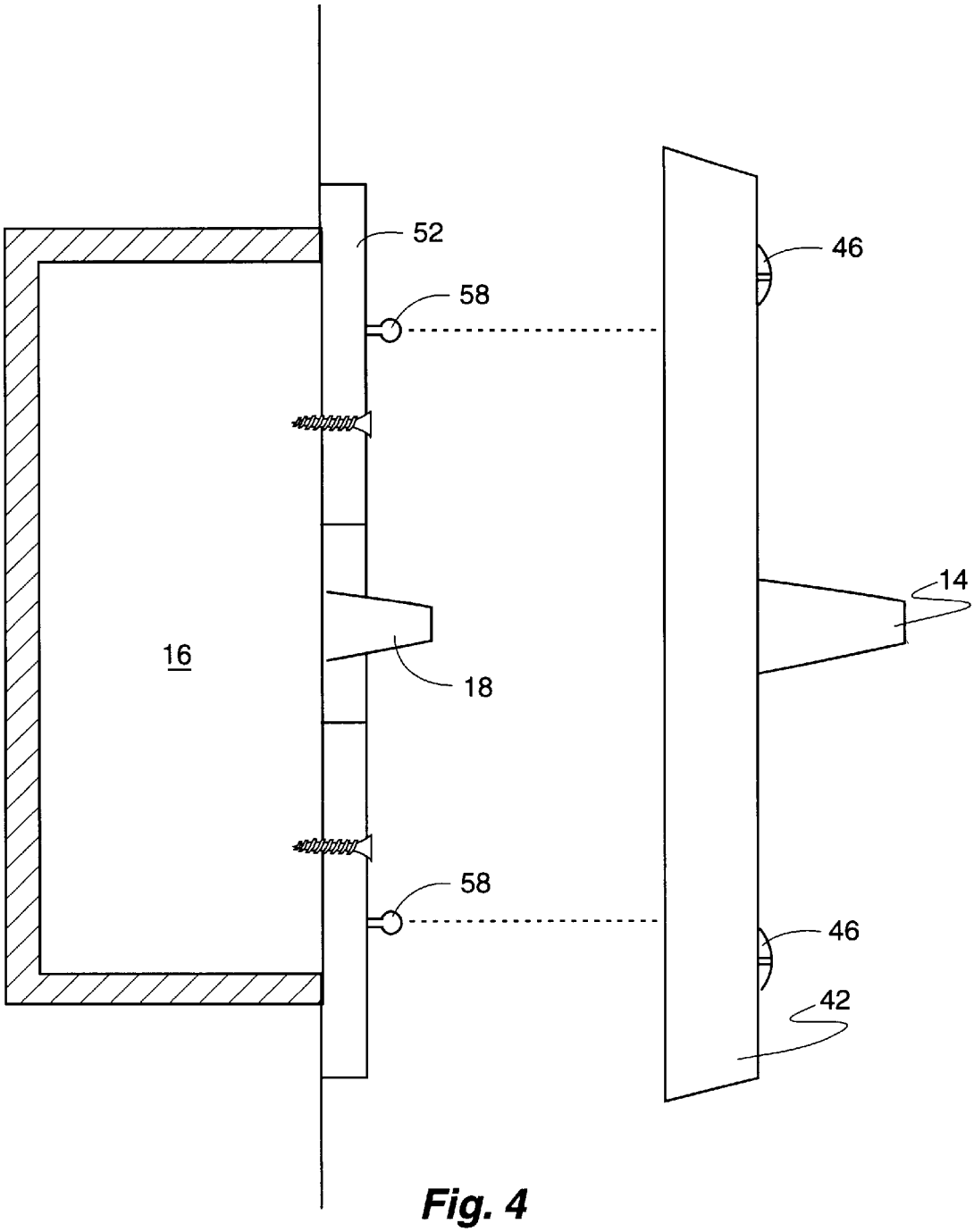
FIG. 4 is a side view of the cover plate in relation to the wall mounting plate.

FIG. 4 more particularly illustrates the relationship of cover plate 42, wall plate 52, and switch 16. Face plate 52 is fixed to switch plate 16 using screws at conventional switch mounting threaded holes 22 (FIG. 1) with second engaging members facing away from switch 16 and rocker arm 18 extending through face plate 52. Cover plate 42 snaps onto wall plate 52 and enlarged toggle 14 engages rocker arm 18 for actuating switch 16. Optional decorative fake screw cover 46 are shown attached to cover plate 42.

Figure 5A:
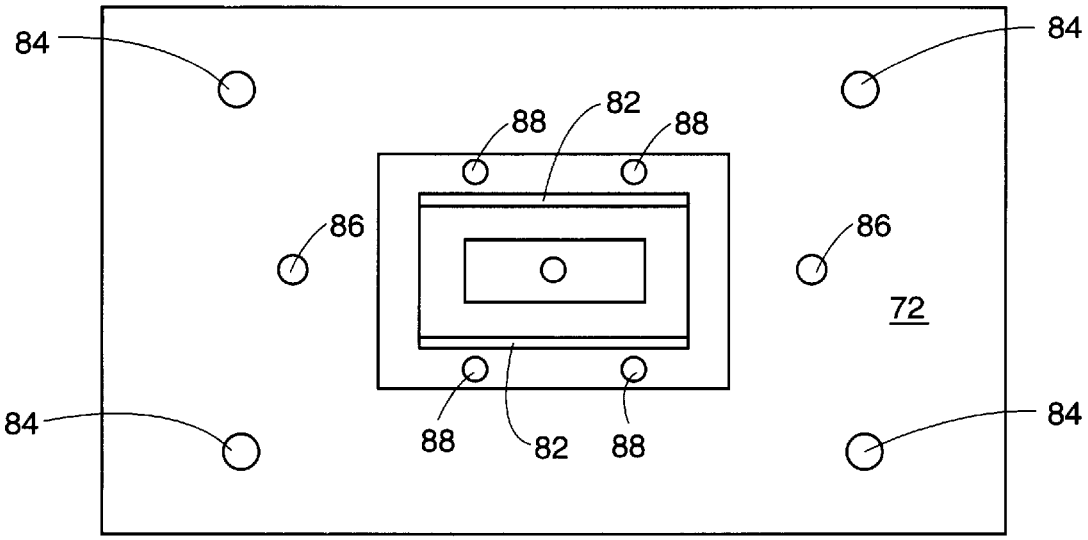
FIGS. 5A and 5B are top and side views of a wall mounting plate and toggle mounting bracket.
Figure 5B:
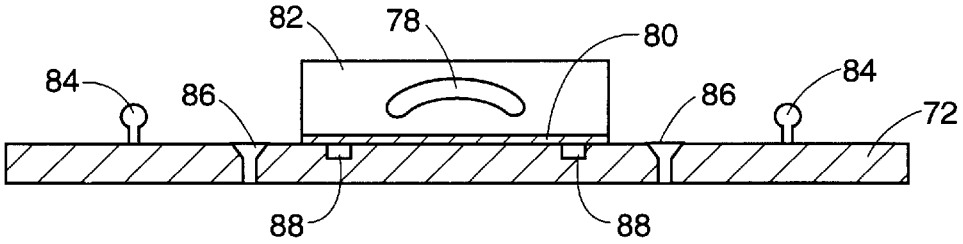

In another embodiment of the present invention, shown in FIGS. 5A and 5B, toggle guide flanges 82 depend outwardly from wall plate 72 toward cover plate 42 (FIG. 4). Wall plate 72 includes screw mounting holes 86, second engaging member 84, shown as cylindrical wells, as described above for wall plate 52 (FIG. 3B). Guide flanges 82 define arcuate grooves 78 or guide nubs (not shown) for controlling rotation of extension toggle 14 (FIG. 2). In one embodiment, flanges 82 are molded with base plate 80 with an aperture for accepting a switch rocker arm. It is preferred to include alignment dowels 88 for aligning base plate 80 on wall plate 72. Flanges 82 have sufficient flexibility to simply wedge toggle 14 between the flanges and into mating contact with grooves 78 or nubs, if provided. In this embodiment, cover plate 42 (FIG. 4) can simply be snapped off of ball members 84 depending from wall plate 72 to exchange cover plates. Toggle 14 remains fixed within flanges 82 for use with the new cover plate.

Figure 6A:
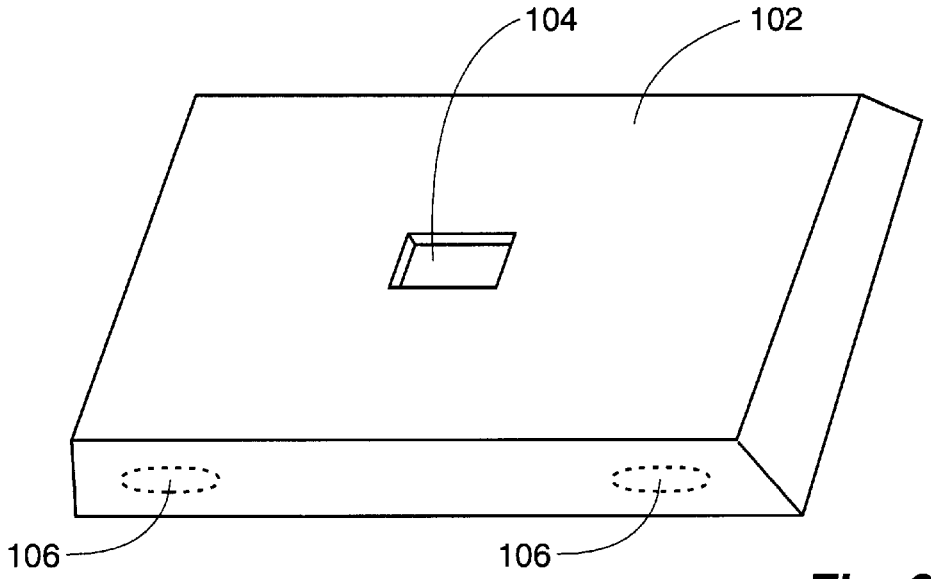
FIGS. 6A and 6B are isometric illustrations of a decorative facing plate that removably engages a cover plate, such as shown in FIGS. 1 and 3A.
Figure 6B:
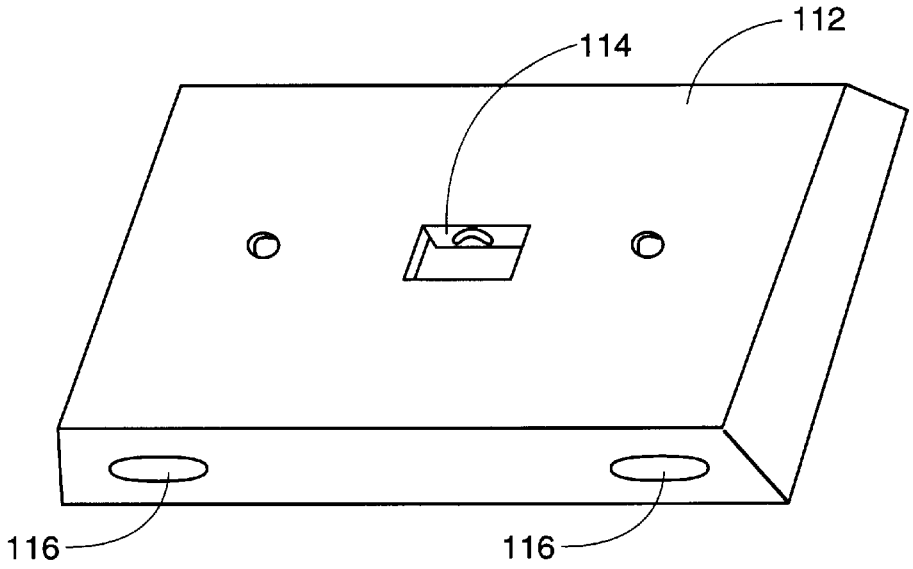

In yet another embodiment of the present invention, shown in FIGS. 6A and 6B, a decorative facing plate 102 may be provided in a variety of colors or decorative configurations so that a variety of such plates may be quickly interchanged to suit changes in a room decoration. Facing plate 102 defines opening 104 to accept a rocker arm toggle extension (see, e.g., FIG. 2) and further defines engagement means 106 that removably engage mating engagement means 116 in cover plate 112. Cover plate 112 includes the features described for the cover plates 12 (FIG. 1) and 42 (FIG. 3A). Cover plate 114 further defines opening 114 for the rocker arm toggle extension (FIG. 2) and mating engagement means 116. In a preferred embodiment, engagement means 106 and 1 16 are elongated male and female surfaces that are urged together by flexible side walls in face plate 102. Thus, face plate 102 may be readily "snapped" on and off of cover plate 112. The edges of face plate 102 may be beveled, as described above for cover plate 42 (FIG. 3A), so that no appliances are needed to snap off the plate.

The foregoing description of the preferred embodiments of the invention has been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An enlarged cover plate assembly with use with a conventional electrical wall switch having a rotatable rocker arm within a mounting bracket with threaded mounting holes with a spacing for conventional cover plates, comprising:

an enlarged cover plate having an area substantially greater than an area of said wall switch and having a front surface forming a decorative surface and a back surface facing said wall switch, and further defining an aperture connecting said front and back surfaces having a length less than a distance between said mounting holes;

means for attaching said enlarged cover plate to said mounting bracket;

two flanges extending between said back surface of said enlarged cover plate and said wall switch and oriented so that said rocker arm moves parallel with said flanges; and a rocker arm extension toggle having a first actuating portion that is accessible from said front surface of said enlarged cover plate, a second engaging portion having a cavity therein for loosely engaging said wall switch rocker arm;

wherein said flanges define arcuate grooves therein and said toggle defines raised portions thereon that engage said arcuate grooves for arcuate sliding movement of said raised portions within said grooves as said toggle rotates.

2. An enlarged cover plate assembly according to claim 1, wherein said means for attaching said enlarged cover plate to said mounting bracket is a wall plate fixed to said wall switch.

3. An enlarged cover plate assembly according to claim 2, wherein said flanges depend from said wall plate toward said back surface of said cover plate.

4. An enlarged cover plate assembly according to claim 2, further including a toggle mounting fixture having a base plate for mounting on said wall plate and two flanges depending from said base plate for guiding rotation of said rocker arm extension toggle.

5. An enlarged cover plate assembly according to claim 2 further including a face plate configured to removably engage said cover plate to provide decorative enhancements above said cover plate.

6. An enlarged cover plate assembly according to claim 5, wherein said face plate and said cover plate define mating components that snap together to removably attach said face plate to said cover plate.

7. An enlarged cover plate assembly according to claim 1 further including a face plate configured to removably engage said cover plate to provide decorative enhancements above said cover plate.

8. An enlarged cover plate assembly according to claim 7, wherein said face plate and said cover plate define mating components that snap together to removably attach said face plate to said cover plate.

9. An enlarged cover plate assembly with use with a conventional electrical wall switch having a rotatable rocker arm within a mounting bracket with threaded mounting holes with a spacing for conventional cover plates, comprising:

an enlarged cover plate having an area substantially greater than an area of said wall switch and having a front surface forming a decorative surface and a back surface facing said wall switch, and further defining an aperture connecting said front and back surfaces having a length less than a distance between said mounting holes;

means for attaching said enlarged cover plate to said mounting bracket;

two flanges extending between said back surface of said enlarged cover plate and said wall switch and oriented so that said rocker arm moves parallel with said flanges; and a rocker arm extension toggle having a first actuating portion that is accessible from said front surface of said enlarged cover plate, a second engaging portion having a cavity therein for loosely engaging said wall switch rocker arm so that said toggle moves through a greater angle than said switch rocker arm as said toggle rotates to actuate said switch rocker arm;

wherein said toggle defines arcuate grooves therein and said flanges define raised portions thereon that engage said arcuate grooves for arcuate sliding movement of said raised portions within said grooves as said toggle rotates through said greater angle than said switch rocker arm.

10. An enlarged cover plate assembly according to claim 9, wherein said means for attaching said enlarged cover plate to said mounting bracket is a wall plate fixed to said wall switch.

11. An enlarged cover plate assembly according to claim 10, wherein said flanges depend from said wall plate toward said back surface of said cover plate.

12. An enlarged cover plate assembly according to claim 10, further including a toggle mounting fixture having a base plate for mounting on said wall plate and two flanges depending from said base plate for guiding rotation of said rocker arm extension toggle.

13. An enlarged cover plate assembly according to claim 10 further including a face plate configured to removably engage said cover plate to provide decorative enhancements above said cover plate.

14. An enlarged cover plate assembly according to claim 13, wherein said face plate and said cover plate define mating components that snap together to removably attach said face plate to said cover plate.

15. An enlarged cover plate assembly according to claim 9 further including a face plate configured to removably engage said cover plate to provide decorative enhancements above said cover plate.

16. An enlarged cover plate assembly according to claim 15, wherein said face plate and said cover plate define mating components that snap together to removably attach said face plate to said cover plate.

* * * * *